United States Patent [19]

Persson

[11] 4,350,099

[45] Sep. 21, 1982

[54] CARGO PALLET

[75] Inventor: Nils G. W. Persson, Ljungsbro, Sweden

[73] Assignee: Nilssuns Industriemballage AB, Ljungsbro, Sweden

[21] Appl. No.: 152,175

[22] Filed: May 22, 1980

[30] Foreign Application Priority Data

Jan. 6, 1979 [SE] Sweden ..... 7904847
Jun. 7, 1979 [SE] Sweden ..... 7905923

[51] Int. Cl.[3] ..... B65D 19/26; B65D 19/06

[52] U.S. Cl. ..... 108/56.1; 108/51.1; 206/600

[58] Field of Search ..... 108/56.1, 56.3, 54.1, 108/51.1, 51.3; 206/386, 599, 600, 596, 598

[56] References Cited

U.S. PATENT DOCUMENTS

| | | | |
|---|---|---|---|
| 2,930,560 | 3/1960 | Carnwath et al. | 108/56.1 |
| 3,267,884 | 8/1966 | Lessheim | 108/56.1 |
| 3,342,146 | 9/1967 | Lessheim | 108/56.1 X |
| 3,469,542 | 9/1969 | Ahlenius | 18/56.1 |
| 3,812,792 | 5/1974 | LaBelle | 108/56.1 |
| 3,927,624 | 12/1975 | Hewson | 108/56.1 |
| 4,028,971 | 6/1980 | Persson | 108/51.1 |
| 4,079,907 | 3/1978 | Mykleby | 206/599 X |

*Primary Examiner*—William E. Lyddane
*Attorney, Agent, or Firm*—Sherman & Shalloway

[57] ABSTRACT

The invention relates to a cargo pallet preferaly intended to transport corrugated cardboard containers and the like. The pallet is characterized in that it is assembled of two components in the form of struts 1,2 provided with blocks and capable in carrying position to be interlocked by action of gravity, one said strut 1 entering a groove in said second strut 2. The struts are pivotal relative one another so as to be located in parallel with each other in a transport position, the pivotal movement occurring about a central block 3 on one strut 1.

At a particularly favorable embodiment of locking means is provided between the pallet and a loose deck or the lower surface of a cardboard packing or the like by means of two or four upright short cylindric guides (8) located on the upper surface of the pallet (1), which guides preferably have the same diameter as the pallet feet (4) and are intended to co-operate with corresponding holes (9) in the lower surface of the cardboard packing or the like, in order to prevent the packing (11,13,14) to slide to either side in relation to the pallet.

4 Claims, 8 Drawing Figures

CARGO PALLET

This invention relates to a pallet of the kind to be used for transporting bulky goods, boxes and the like in order to protect the same and to facilitate their handling, for example by fork trucks or the like. Pallets at present in use are to a certain extent standardized to so-called Europe-pallets. These pallets are solidly manufactured of wood and normally are desired to be returned to the consignor. The pallets are relatively expensive, splintery, heavy and difficult to handle.

The present invention relates to a foldable pallet, which in collapsed state is much less bulky than conventional pallets. In collapsed state about 10,000 pallets according to the invention can be transported on a lorry, which only holds 1200 pallets of conventional type. The savings implied are substantial and, of course, are obtained also when the pallets are stored.

The pallet according to the present invention, besides, has a lighter weight than the standard pallet, is cheap to manufacture and meets substantially the same strength requirements as the standard pallet.

The pallet according to the present invention is particularly well adapted for the transport of corrugated cardboard containers and boxes, as will be explained in greater detail below.

Figure 1:
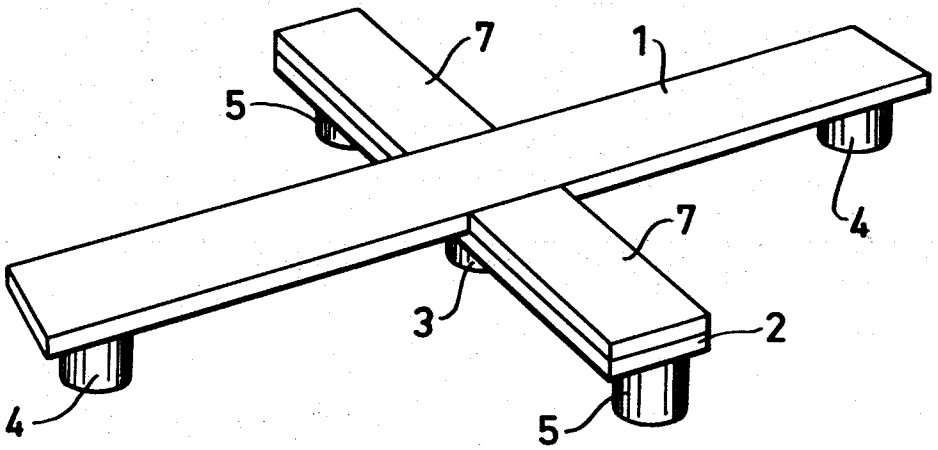
Figure 2:
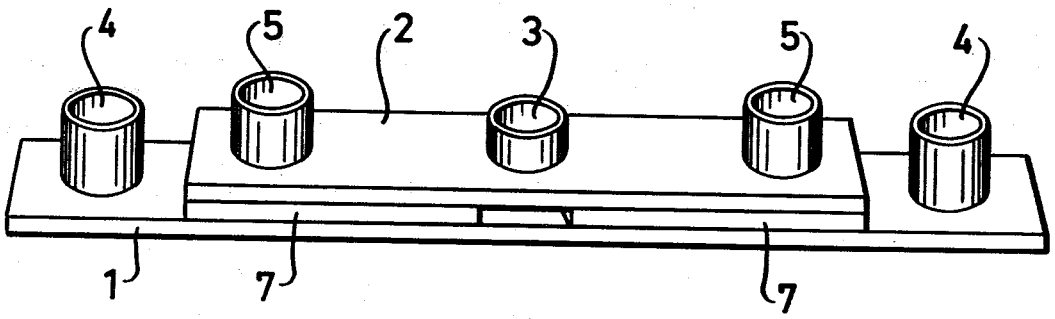
Figure 3:
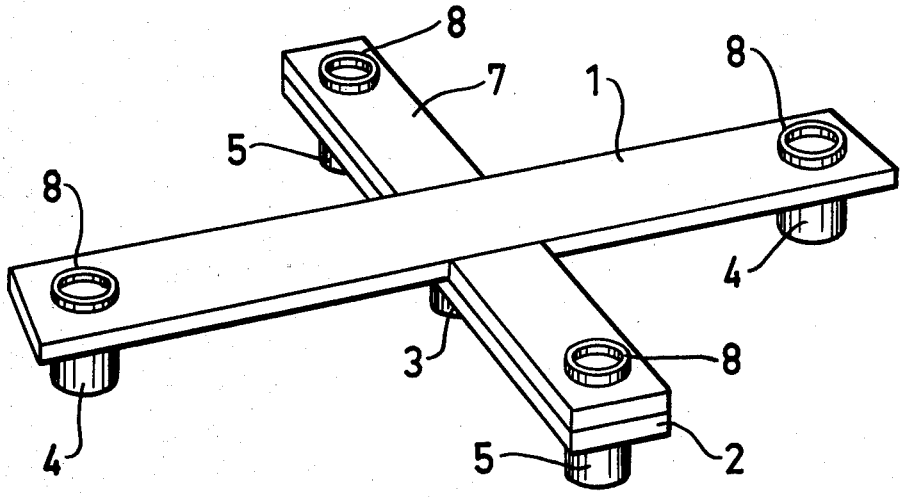
Figure 4:
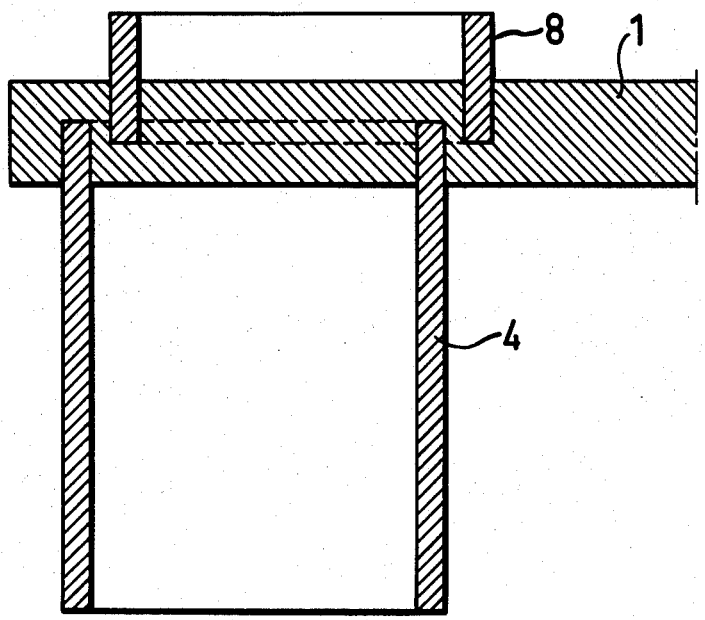
Figure 7:
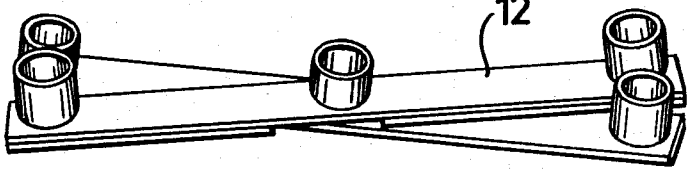
Figure 8:
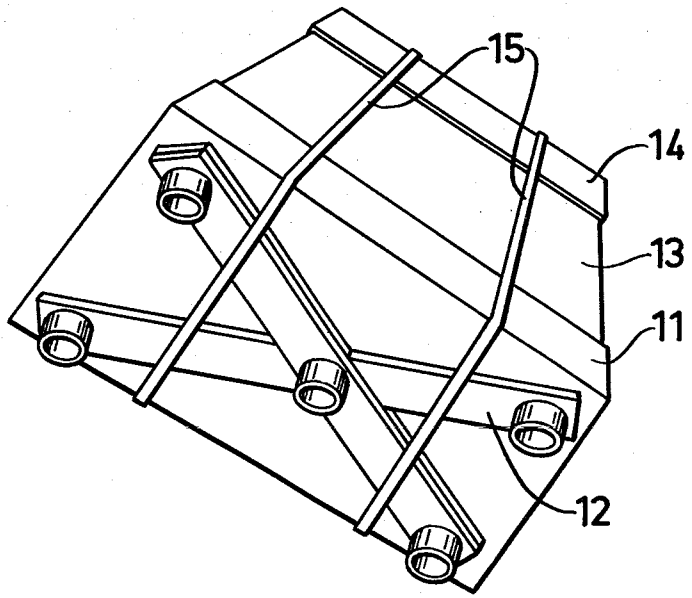
Figure 5:
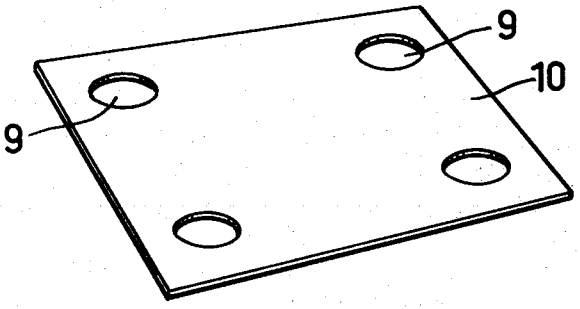
Figure 6:
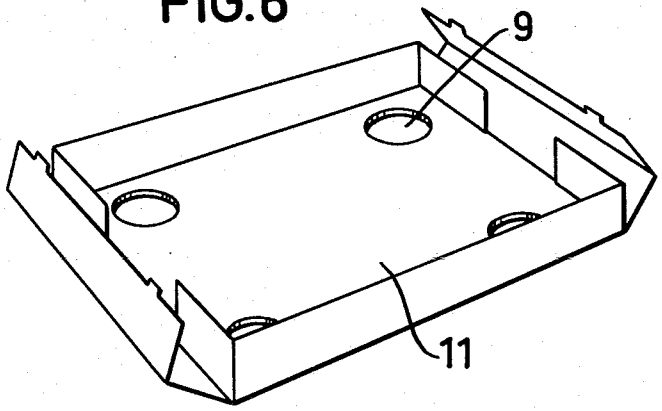

Two embodiments of the present invention are described in the following, with reference to the accompanying drawings, in which FIG. 1 is a perspective view of the pallet in operative position seen obliquely from above, FIG. 2 shows the same pallet in collapsed state, seen obliquely from below, FIG. 3 shows a cross-shaped pallet intended to be attached together for transport, provided with four locking rings or locking sleeves according to the invention, FIG. 4 is a section through one of the arms in a cross-shaped pallet or through a deck, showing the location of the locking ring relative to the pallet foot, FIG. 5 shows a detached deck intended to co-operate with a pallet foot provided with locking rings, FIG. 6 shows another embodiment of a deck, FIG. 7 shows a foldable pallet in collapsed state, and FIG. 8 shows the same pallet in operative position, on the lower surface of a cardboard box, provided with holes, which co-operate with the guide rings and wrappings of strips or the like for effectively fixing a cardboard box to the pallet in all directions.

As is apparent especially from FIGS. 1 and 3, the pallet according to the present invention is assembled of two main components, one of which is a strut 1 provided with three blocks (feet) 3,4,4. At the embodiment shown, said blocks in a manner known per se are made from cylindric pipes of e.g. cardboard or similar plastic, which if necessary can be impregnated against moisture. The second strut 2 is provided at its outer ends with two identical blocks 5,5 and has at its centre a hole of a dimension corresponding to the central block 3 on strut 1. The strut 2, as appears from the Figures, preferably is assembled of three members of equal thickness, the through member 2 thereof is provided with the hole for the central block 3 on the strut 1, and of two members 7 being in operative position the upper members and defining a central groove capable of unfolding to receive the board 1, which thereby with its upper surface is at the same level as said members 7.

For assembling the pallet, the struts are turned to form a cross, which has a total of five blocks abutting the support. Owing to the groove in said member 2, the member 1 is retained in correct angular position relative to the member 2. The members 7 preferably are glued on the strut 2, because nailing results in a substantially lower strength and, moreover, renders recovery in the form of chips or the like difficult.

For folding the pallet, the strut 1 is lifted slightly so that the board 1 (or particle board strip) disengages from the groove in the member 2, whereafter the members are pivoted through a certain angle, for example 90°, in relation to each other, so that a package of the kind shown in FIG. 2 is formed.

In collapsed state the dimensioning may be such that for the two outer blocks 5 on the member 2 space is available between the outer blocks 4 on the strut 1 and the central block 3.

This foldable pallet is particularly well adapted for the transport of corrugated cardboard containers, boxes and cases, because they normally are secured by rivets on the underlying pallet. By rivetting (stitching) the corrugated cardboard cases to the pallet, the members are locked in cross-shape, and there is no risk for the member 1 to be lifted out of the groove in the member 2.

It was found at the stacking of corrugated cardboard boxes on pallets of this kind, that the hold obtained is better than when the boxes are stacked on conventional pallets. The blocks attach to the upper part of the underlying box and provide full safety against sliding. It may be expedient for certain purposes to provide the blocks with a bottom (not shown), which may be circular, square or consist of runners connecting the end surfaces of two or more blocks.

The pallet shown in FIG. 3 also is assembled of two main components, one of which is a strut 1 provided with three blocks (feet) 3,4,4. The second strut 2, as at the pallet in FIG. 1, is provided at its outer ends with two similar blocks 5,5 and has at its centre a hole corresponding in dimension to the central block 3 on the strut 1. From FIG. 3 is further apparent that the cross on its upper surface is provided with four locking rings 8, one of which is shown cut through (for example the left-hand end of the strut 1) in FIG. 4. As can be seen, according to the invention the guides 8 are not positioned concentrically with the pallet feet 4. It would apparently be a simplification to design the pallet foot 4, which may have the same diameter as the guide ring 8, so that it extends right through the strut 1 and subsequently is glued. Experiments, however, have proved it very difficult to obtain in this way sufficient strength, because a through-block can be pressed to slide relative to the strut 1. The non-concentric jointing of the components, as shown in FIG. 2, effects a very stable attachment. Conventional methods of attaching packing to a pallet, by means of nailing, stitching, rivetting or the like, all have the disadvantage that stresses in lateral direction are taken up on a very small surface. Collision or other pushing forces therefore easily give rise to holes and cracks in the cardboard box bottoms.

Due to the very strongly glued circular guides with relatively large diameter according to this embodiment of the invention, the forces in lateral direction are well distributed about the periphery of the guides, and a very good stability is obtained.

Although this embodiment of the invention has the primary object of bringing about a slide-proof connection between a cardboard box packing or the like and a simple pallet, it was found suitable in many cases to add to the container plus pallet an associated further deck, including four holes, see FIG. 5, for possible return dispatch when some other form of packing is used. In this way, the pallet can be re-used repeatedly.

It is particularly suitable to use as said extra deck a usual per se known embodiment of a cardboard bottom, which in FIG. 6 is shown provided with four holes. Experiments have proved that when this bottom 11, which originally is punched in one plane and then folded to form upright edges, is made of paraffin-treated corrugated cardboard, a water-proof, cheap and very stable bottom is obtained which is very well adapted for co-operation with holding rings according to the invention.

FIG. 7 shows a collapsed isosceles pallet 12, which in FIG. 8 is shown seen from below in a state ready for transport. From FIG. 8 the holes and locking rings do not appear, but the bottom 11 is shown jointed, enclosing a sleeve (a so-called charner 13) with a cover 14. Locking strips are thereafter tightened about pallet and container, so that a stable transportation unit is obtained.

One main idea at the construction and design has been to completely avoid in the pallet the use of nails, screws and other metal objects. The object thereof is that the pallet in its entirety shall permit its scrapping to chips or pulp and consequently be beaten without risk, that metal objects may ruin the pulp as well as, for example, the cutters.

The pallet according to the present invention is very cheap to manufacture, partially because it is based on and makes use of such components, which already are used a.o. in the production of pallets.

This pallet type, as already mentioned, is very favourable in that the high transportation and storage costs for the pallet are substantially reduced. The foldability further renders it possible to return a large number of pallets on a smaller area (cheaper freight) than heretofore possible.

I claim:

1. A cargo pallet for the transport of containers comprising first and second struts, each strut being provided with a plurality of blocks and pivotable relative to each other, the block which is arranged at the center of said first strut having an external cylindrical form and serving as the bearing pin when said first and second struts are pivoted from one position to another position, said second strut being provided with a transverse groove and an aperture located in the groove for receiving said central block, said transverse groove housing and fixing said first strut with said central block of said pallet in the operating position.

2. The pallet of claim 1 wherein all of said blocks are in cylindrical shape and have such lengths that when the pallet is in an operating position, the bottom of said blocks are in a common plane.

3. The pallet of claim 1 wherein the upper surface of each strut is provided with a plurality of upwardly extending cylindrical locking means which are placed in circular grooves countersunk therein.

4. The pallet of claim 3 wherein said locking means and said blocks are arranged non-concentrically so that the grooves for attaching said locking means and blocks intersect each other.

* * * * *

UNITED STATES PATENT AND TRADEMARK OFFICE

CERTIFICATE OF CORRECTION

PATENT NO. : 4,350,099

DATED : September 21, 1982

INVENTOR(S) : Nils G. W. Persson

It is certified that error appears in the above—identified patent and that said Letters Patent is hereby corrected as shown below:

Title page:

Assignee should read -- Nilssons Industriemballage AB, ---

Foreign Application Priority Data should read:

"Jan. 6, 1979" should read -- June 1, 1979 --.

"Jun. 7, 1979" should read -- July 6, 1979 --.

Signed and Sealed this

Ninth Day of August 1983

[SEAL]

*Attest:*

GERALD J. MOSSINGHOFF

*Attesting Officer* *Commissioner of Patents and Trademarks*